United States Patent [19]

Mundschau

[11] Patent Number: 4,896,807

[45] Date of Patent: Jan. 30, 1990

[54] WEB GUIDE APPARATUS

[75] Inventor: David L. Mundschau, Waukesha, Wis.

[73] Assignee: Quad/Tech, Inc., Pewaukee, Wis.

[21] Appl. No.: 181,980

[22] Filed: Apr. 15, 1988

[51] Int. Cl.[4] ..... B65H 23/038

[52] U.S. Cl. ..... 226/21

[58] Field of Search ..... 226/18, 19, 20, 21, 226/22, 23; 250/572

[56] References Cited

U.S. PATENT DOCUMENTS

| | | | |
|---|---|---|---|
| 4,069,959 | 1/1978 | Bartell et al. . | |
| 4,204,619 | 5/1980 | Damour . | |
| 4,243,167 | 1/1981 | Sander . | |
| 4,291,825 | 9/1981 | Glanz . | |
| 4,335,316 | 6/1982 | Glanz et al. | 250/572 |
| 4,342,412 | 8/1982 | Lorenz et al. . | |
| 4,453,659 | 6/1984 | Torpey | 226/21 X |
| 4,477,006 | 10/1984 | Sharp . | |
| 4,598,849 | 7/1986 | Frye et al. . | |
| 4,606,486 | 8/1986 | Brunner et al. . | |
| 4,648,539 | 3/1987 | Dingerkus | 226/21 X |

*Primary Examiner*—John M. Jillions

*Attorney, Agent, or Firm*—Foley & Lardner

[57] ABSTRACT

A web guide apparatus corrects for high frequency oscillations, sometimes referred to as "web weave", of a travelling web. A light-weight movable carriage is mounted to a rigid support structure and is driven by a brushless DC motor having an integral lead screw and low inertia characteristics. The web guide manifests a response bandwidth in excess of 1 Hz. and preferably at least approximately 8 Hz., and a material resonance outside of the response bandwidth. Lateral web position is detected by a web position detection unit that employs a CCD line sensor. The output signal from the web position detection unit is supplied to a control circuit that generates a PWM signal to drive the brushless DC motor. The control circuit also includes adjustable gain stages that are used to compensate for web float and web flutter that occurs during certain operating conditions.

31 Claims, 13 Drawing Sheets

WEB GUIDE APPARATUS

BACKGROUND OF THE INVENTION

The invention relates generally to web guide apparatus that correct lateral displacements of a travelling web. In particular, the present invention provides a web guide apparatus for use in a high speed printing system that not only corrects large positional offsets, but also corrects for high frequency oscillations in the lateral displacement of the web.

In a high speed printing system, for example, a multi-color printing press, several printing operations are generally performed on a continuous travelling paper web. Proper registration of the web in relation to the various printing operations is required in order to produce a satisfactory end product. On occasion, however, the web may become laterally misaligned, necessitating the use of a web guide apparatus that senses the lateral position of the web and automatically repositions the web.

Various types of web guide apparatus have been employed to correct for lateral displacement of the web. One type in particular employs a movable carriage that is attached to a frame support. Parallel idler rollers are connected to the movable carriage, which in turn is pivoted about a fixed point by a motor in order to guide the web. A sensor is employed to detect the lateral displacement of the web.

While the aforementioned carriage-type web guides perform satisfactorily to correct for slowly varying offsets in the web, they suffer from a serious drawback, namely, the inability to correct for high frequency oscillations in the travelling web. It has been found that high frequency oscillations, e.g., up to on the order of approximately 8 Hz, hereinafter referred to as "web weave", cause smearing to occur in the printing operation. Smearing is especially acute in the first printing operation of a multi-color printing press, as will be explained. The available carriage type web guides are unable to cope with the problem of web weave.

The problem of web weave becomes even more critical as overall system speed capability increases. Thus, it is imperative that current web guides inability to correct for web weave be overcome to avoid web weave becoming a limiting factor in system printing speed.

SUMMARY OF THE INVENTION

The present invention overcomes the limitations of the prior art discussed above and provides a web guide capable of compensating for web weave. More specifically, compensation for web weave is accomplished by providing a response bandwidth in excess of 1 Hz and preferably on the order of 8 Hz or higher, and constructing the web guide to have a natural resonant frequency outside of its response bandwidth.

BRIEF DESCRIPTION OF THE DRAWINGS

A preferred exemplary embodiment will hereinafter be described in conjunction with the appended drawing wherein like designations denote like elements, and.

DETAILED DESCRIPTION OF A PREFERRED EXEMPLARY EMBODIMENT

Figure 1:
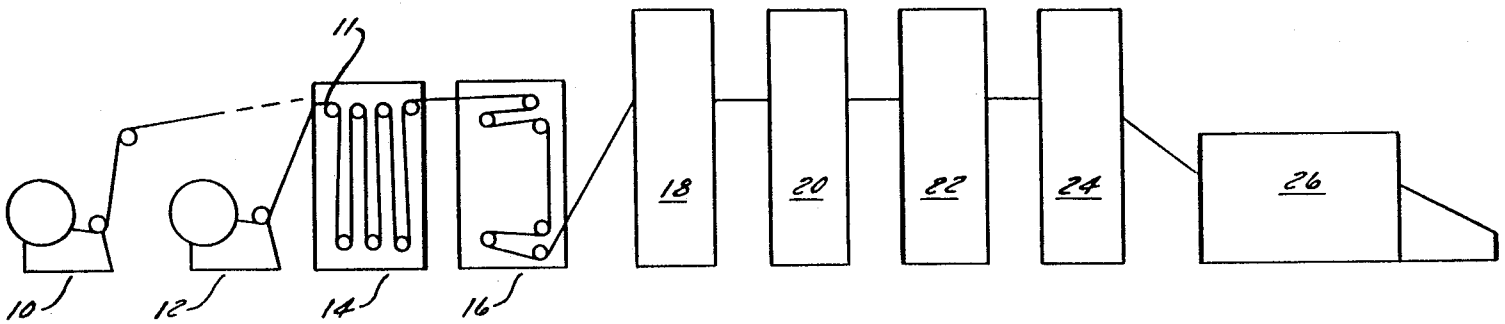
FIG. 1 is a functional block diagram of a multi-color printing press.

Referring now to FIG. 1, a conventional multi-color printing press typically includes two web supply units 10 and 12, a festoon unit 14, a carriage-type web guide 16, four color printing units 18–24, and a finishing unit 26.

Web supply units 10 and 12 and festoon 11 cooperate to provide a continuous web 11 of, e.g., paper. Supply units 10 and 12 each receive and operate upon individual rolls of web. During operation, a paper web is initially fed from one supply unit, e.g., unit 12, to festoon unit 14. When the paper web from paper supply unit 12 is exhausted, a splicing operation is performed and the web from supply unit 10 is supplied to festoon unit 14.

Festoon unit 14 provides a low inertia paper source to the printing units, and additionally provides a buffer so that the splicing operation can be performed without discontinuity in the web supplied to the printing units. Festoon unit 14 includes a number of idler rollers defining a path through which the paper web is guided. At least some of the idler rollers are movable relative to each other, so that the length of web path can be moved. During a splicing operation, the input of the web to festoon unit 14 is restrained, the path through festoon unit 14 is shortened and the web contained in festoon unit 14 is used to maintain a continuous printing operation while the splice is being performed. It is believed that some displacement of the movable idler rollers in festoon unit 14 also occurs during normal operation of the printing press due to variations in web tension and contributes to the problem of web weave. Variations in web tension may be caused, for example, by an out-of-round paper supply roll.

Web 11 exits festoon unit 14 and enters conventional web guide 16. Web guide 16 controls the lateral position of web 11 relative to printing units 18–24; web guide 16 senses the lateral position of the paper web and corrects for offsets from a predetermined position.

As previously noted, current web guides are not capable of correcting for high frequency variations in web position, i.e., web weave. Thus, in systems employing a conventional web guide, the paper web enters the first printing unit 18 (FIG. 1) subject to high frequency oscillations. A lateral displacement on the order of about 0.010 inch or greater, depending on the particular printing operation being performed, can cause unacceptable smearing. Smearing due to web weave appears to be most critical in first printing unit 18 in a multicolor printing press.

Figure 2:
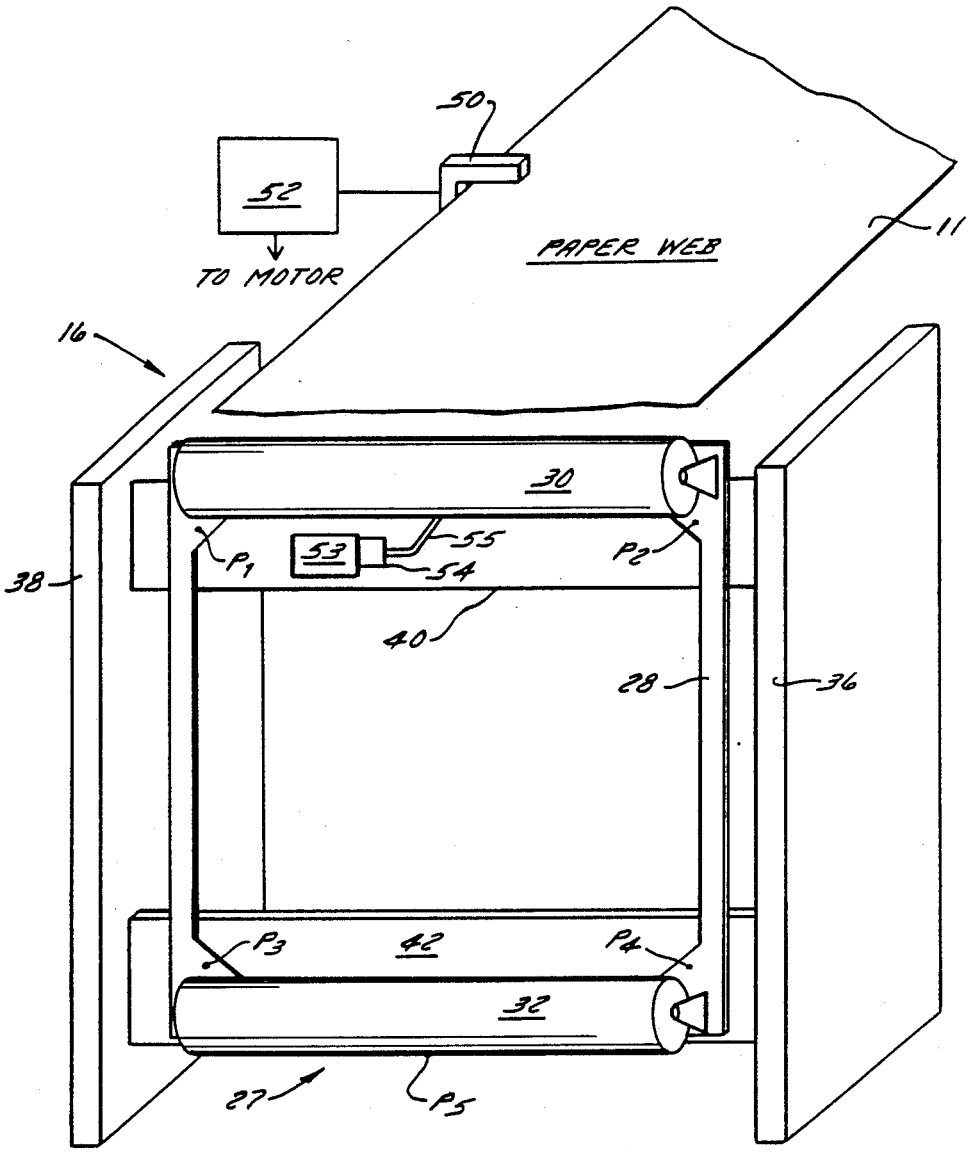
FIG. 2 PRIOR ART
FIG. 2 is a perspective view of a prior art type web guide.
Figure 3:
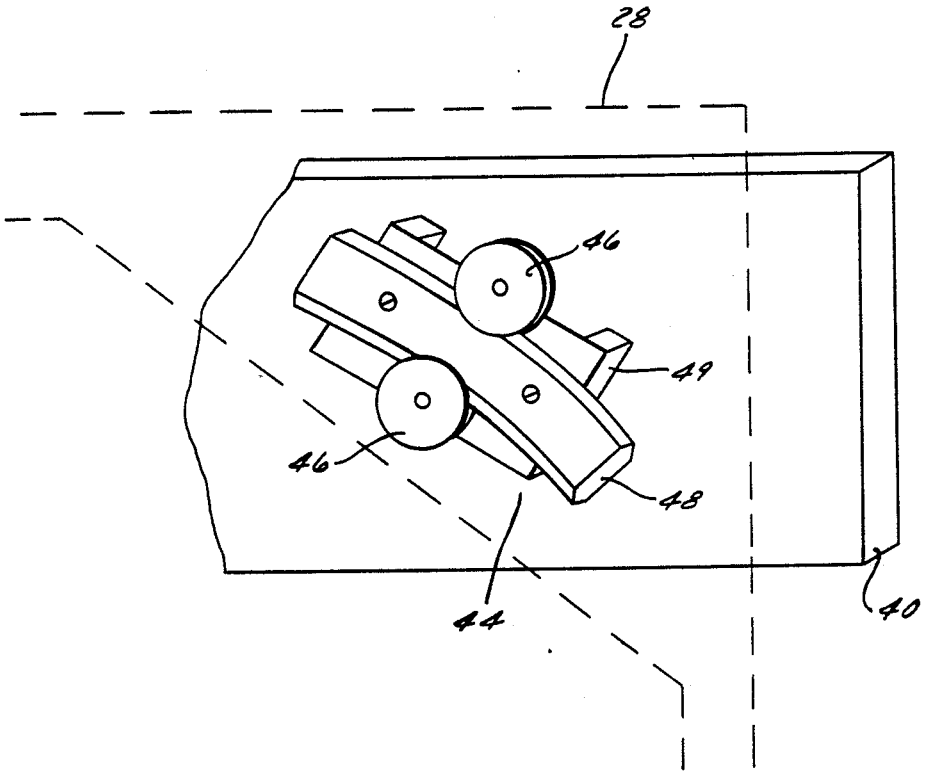
FIG. 3 PRIOR ART
FIG. 3 illustrates a guide rail assembly employed in the web guide illustrated in FIG. 2.

Referring now to FIGS. 2 and 3, prior art carriage type web guide 16 includes a carriage, generally indicated as 27, and a support structure 34 to which carriage 27 is movably connected. Carriage 27 typically comprises a square-shaped movable frame 28 (sometimes referred to as a "floating frame"), and two idler rollers 30 and 32 attached to frame 28. Support structure 34 includes two side plates 36 and 38, connected by two tie bars 40 and 42.

Carriage 27 is mounted for effectively pivotal movement about a virtual pivot point P5. Frame 28 is connected to support structure 34 at four locations (P1–P4). Referring briefly to FIG. 3, pairs of grooved rollers 46 are rotatably mounted on frame 28, at each of points P1–P4, disposed for cooperation with respective guide rail assemblies 44 mounted on tie bars 40 and 42. Guide assembly 44 includes a curved guide rail 48 configured to be received between and engaged by rollers 46. Guide rail 48 is typically secured to, e.g., tie bar 40, by an offset mounting bracket 49.

Referring again to FIG. 2, a drive motor assembly 54 effectively pivots carriage 27 about point P5, responsive to signals indicative of the lateral position of web 11. A sensor unit 50, suitably consisting of a light source that illuminates a photodetector, provides an output signal indicative of the lateral position of web 11 to suitable motor control circuitry 52. Control circuitry 52, in turn, issues motor command signals to drive motor assembly 54. Drive motor assembly 54 typically consists of a conventional brush type DC motor with a reduction gear head assembly, generally indicated as 53, coupled to a lead screw assembly 55 through a universal joint. Motor 53 is typically mounted on tie bar 40, and lead screw assembly secured to frame 28. When the drive motor assembly 54 is activated, and lead screw assembly 55 advanced, frame 28 pivots about virtual pivot point P5. The lateral position of the paper web shifts in the direction of tilt of roller 30.

While conventional web guide 16 sufficiently corrects for low frequency offsets in the web position, it is not capable of dealing with the problem of web weave. Typically, such prior art web guides are limited in bandwidth response to less than about 1 HZ, i.e., can respond only to variations in lateral position that occur at a fequency of less than approximately 1 Hz. The present inventor has recognized that the response bandwidth of the prior art type web guide was insufficient to control web weave, and that to correct for web weave a web guide must provide bandwidth of greater than 1 Hz, suitably at least approximately 2, 3, 4, 5, 6, 7, or 8 Hz or greater, and preferably approximately 8 Hz or greater.

It has been determined that the relatively low (e.g., 1 Hz) response bandwidth of printout web guide 16 is due to a number of factors:

A drive motor assembly 54 is not capable of reacting quickly enough to high frequency oscillations in the web position, i.e., web weave. Brush type DL motor 53 manifests relatively high inertia. In addition, the gear and linkage mechanism of the drive motor assembly 54 manifests a relatively low effective spring constant, and a degree of backlash.

Frame 28 and idler rollers 30 and 32 manifest relatively high inertia; they are typically constructed of steel and together have an estimated inertia of e.g., 23.2 ft-lb-sec$^2$. The high inertia makes it additionally difficult to correct for high frequency oscillations in the web position; even if motor assembly 54 could react quickly enough, frame 28 tends to overshoot the desired control position due to inertia of the frame and the backlash in the system.

Figure 5A:
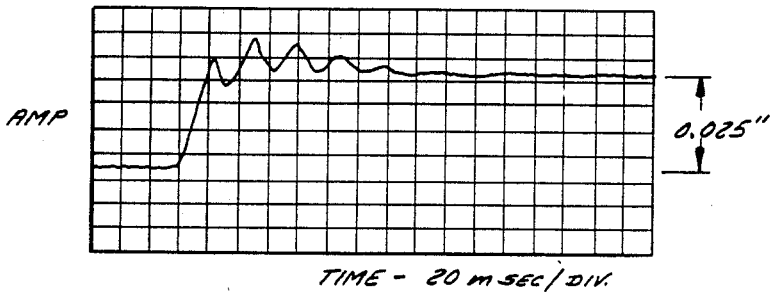
FIGS. 5*a* and 5*b* are graphs illustrating carriage position in response to a movement command.

It has also been determined that over and above the response bandwidth limitations, support structure 34 has a natural tendency to resonate at frequencies in the range of frequencies corresponding to web weave. This resonance is due to the configuration of the support structure and the reaction force produced by motor 53 when moving frame 28. Thus, even if motor 53 was capable of providing a sufficiently fast response, the interaction of the natural resonance of support structure 34 and the reaction force tend to result in overall system resonance which may transfer to the web. An example of the aforementioned resonance problem is illustrated in FIG. 5*a*, in which a stepper motor was employed as the motor 53. A ringing effect in the movement of frame 28 occurred in response to a 0.025 inch step command.

Figure 4:
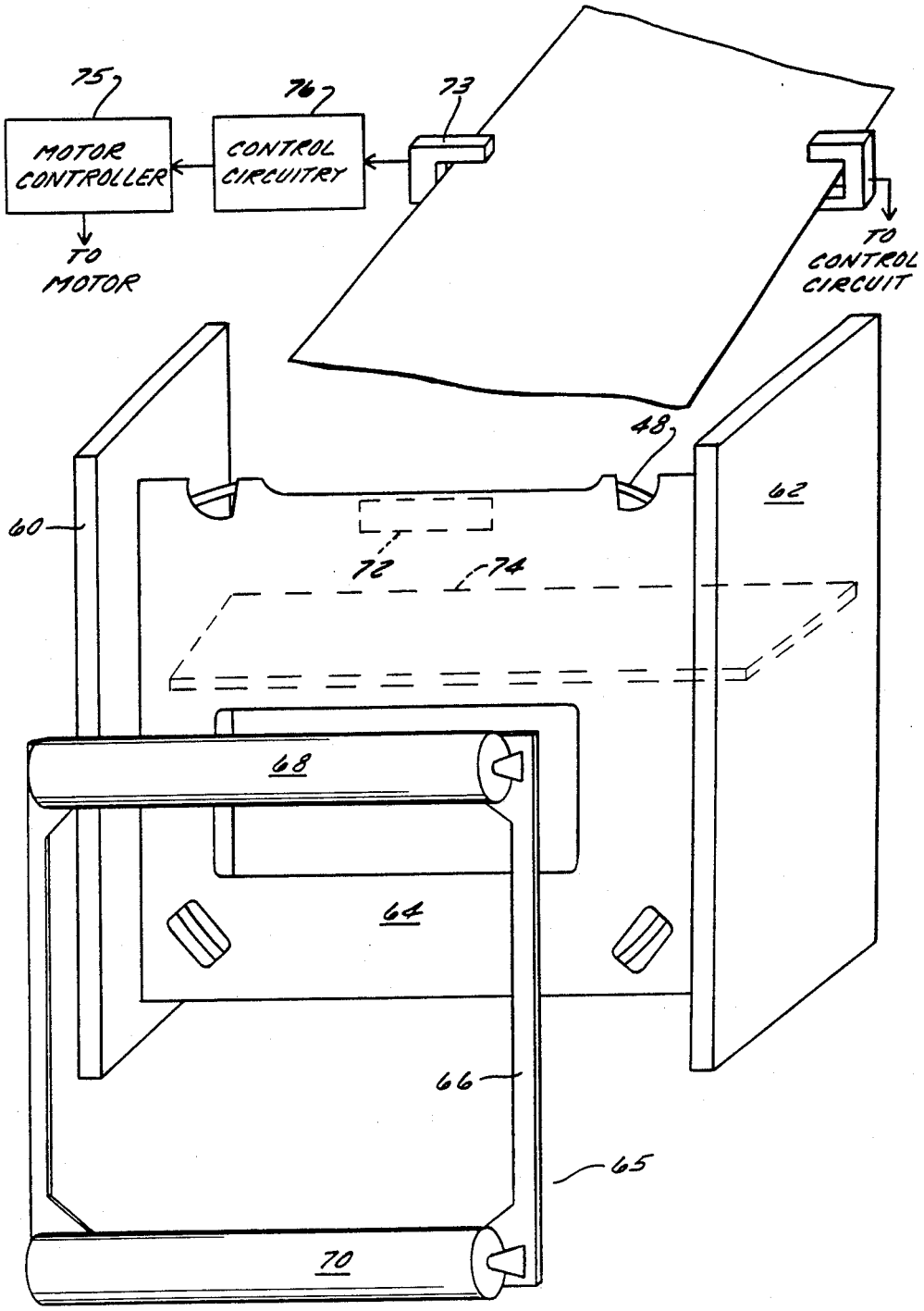
FIG. 4 illustrates a web guide in accordance with a preferred embodiment of the invention.

Referring now to FIG. 4, a web guide in accordance with a preferred embodiment of the invention includes: a support structure 34A comprising two side plates 60 and 62, and a rigid tie plate 64; a movable carriage 65 comprising a frame 66 and two idler rollers 68 and 70; a motor drive assembly 72 mounted on the back side of the rigid tee plate 64; two web position sensing units 73 located on either side of the web; a motor controller 75; and suitable control circuitry 76.

Figure 5B:
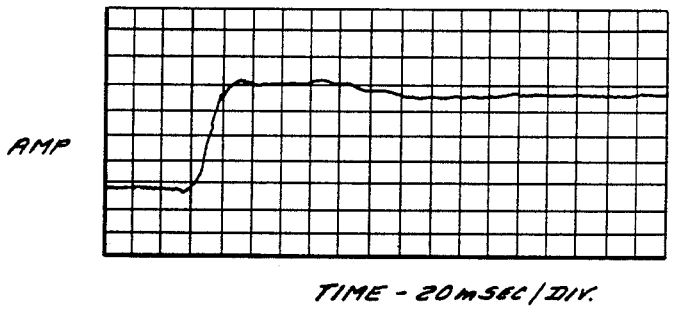

Support structure 34A is configured so that the structure resonance is outside of the range of frequencies corresponding to web weave. To provide a sufficiently stiff overall structure, rigid plate 64 is employed instead of the tie bars 40 and 42 of the prior art. In addition, a horizontal plate 74 is coupled to side plates 60 and 62 and rigid tie plate 64 to further stiffen the web guide structure. By so stiffening the structure, the resonance of the structure is shifted well outside of the control bandwidth necessary to eliminate web weave. When the tie bars 40 and 42 of the guide having the response shown in FIG. 5A were replaced with a solid plate, the response curve illustrated in FIG. 5*b* was obtained. Thus, the ringing response was eliminated by increasing the stiffness of the frame.

Frame 66 is mounted to the rigid plate at four locations using rollers and guide rails similar to those used in the web guide illustrated in FIG. 2. However, in order to further stiffen the web guide structure and avoid possible movement of frame 66 due to the reaction force of drive motor unit 72, guide rails 48 are mounted directly to rigid tie plate 64, over respective apertures in the plate, thereby eliminating offset mounting brackets which may flex when force is applied by motor drive assembly 72 to move frame 66.

In accordance with another aspect of the present invention the response bandwidth of the system is increased to greater than 1 Hz and preferably at least 8 Hz. To facilitate the increased bandwidth, relatively low inertia carriage 66 is employed. To this end, frame 66 and idler rollers 68 and 70 are constructed of aluminum to reduce the weight of the carriage. The lower carriage inertia makes it possible to quickly and easily position the carriage while at the same time reducing the torque requirements for drive motor assembly 72. Using aluminum idler rollers having a wall thickness of not greater than about 0.50 inches, and preferably around 0.10 inch, the carriage weight is reduced to an estimated inertia of preferably 8.9 ft-lb-sec$^2$ or less.

Figure 6A:
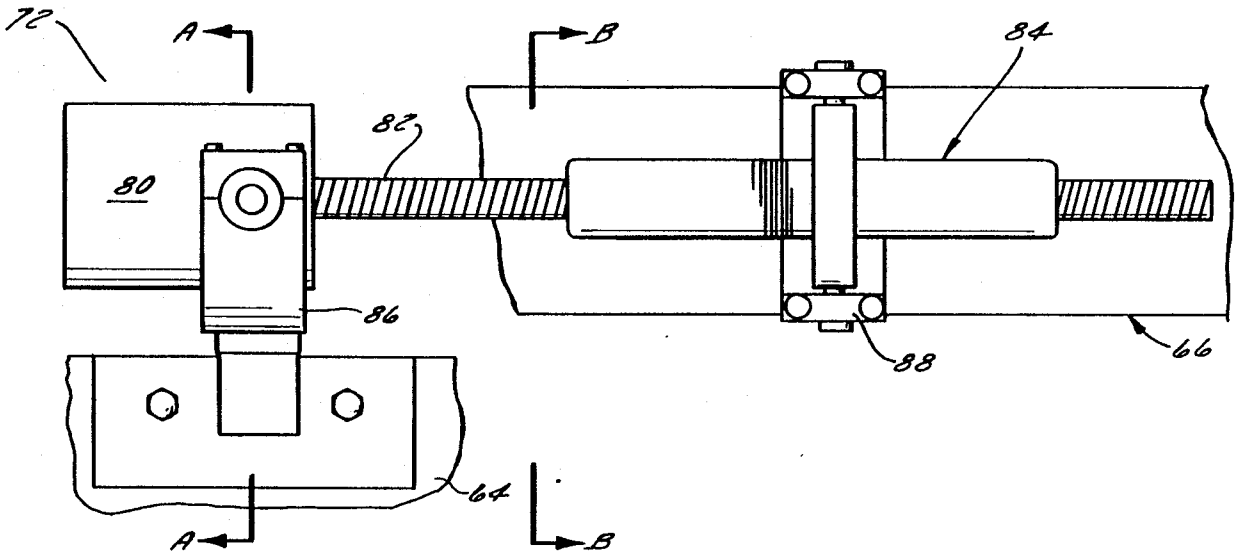
FIG. 6*a* illustrates a motor drive assembly employed in the web guide illustrated in FIG. 4.
Figure 6B:
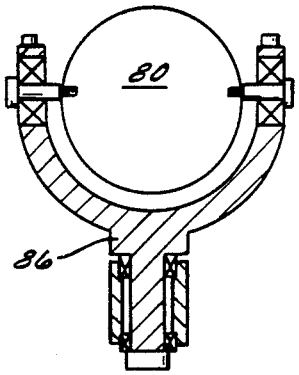
FIG. 6*b* is a sectional view of the motor drive assembly illustrated in FIG. 6*a* taken along the line A—A.
Figure 6C:
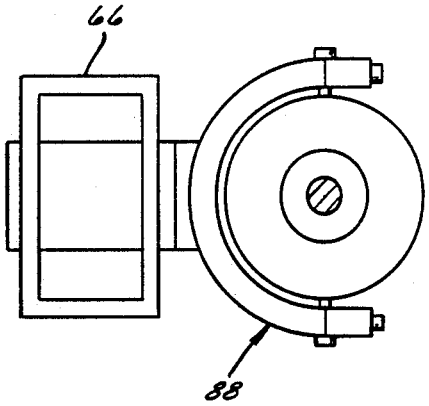
FIG. 6*c* is a sectional view of the motor drive assembly illustrated in FIG. 6 taken along the line B—B.

Increased bandwidth and out-of-bandwidth resonance is further facilitated by utilizing a drive motor assembly 72 manifesting relatively low inertia, and a high effective spring constant (i.e., is relatively stiff). Referring now to FIGS. 6a–6c, drive motor assembly 72 suitably compromises: a brushless DC motor 80, having an integral lead screw 82; a ball nut assembly 84; and respective oar lock brackets 86 and 88. Motor 80 is mounted to rigid tie plate 64 by motor oar lock bracket 86. Second oar lock bracket 88, disposed rotated 90 degrees with respect to the motor oar lock bracket 86, couples lead screw 82 and ball nut assembly 84 to frame 66. Oar locks 86 and 88 eliminate binding friction by correcting for any misalignments in the mounting of the motor assembly 72.

Rotary motion of motor 80 is translated to linear motion by the lead screw 82 and ball nut assembly 84. Ball nut assembly 84 includes two ball nuts having ball bearings that ride on lead screw 82 to provide a low friction rotary to linear conversion. The use of an integral lead screw stiffens the motor assembly and eliminates the necessity of gears or couplings that can cause backlash. The integral lead screw 82 is preferably a single piece, but may also consist of two or more pieces that are pinned together to form an integral unit. Preferably, lead screw 82 has a pitch of two. Increasing the pitch would provide more torque at the carriage, but would also tend to cause more resonance in the overall system.

Figure 7:
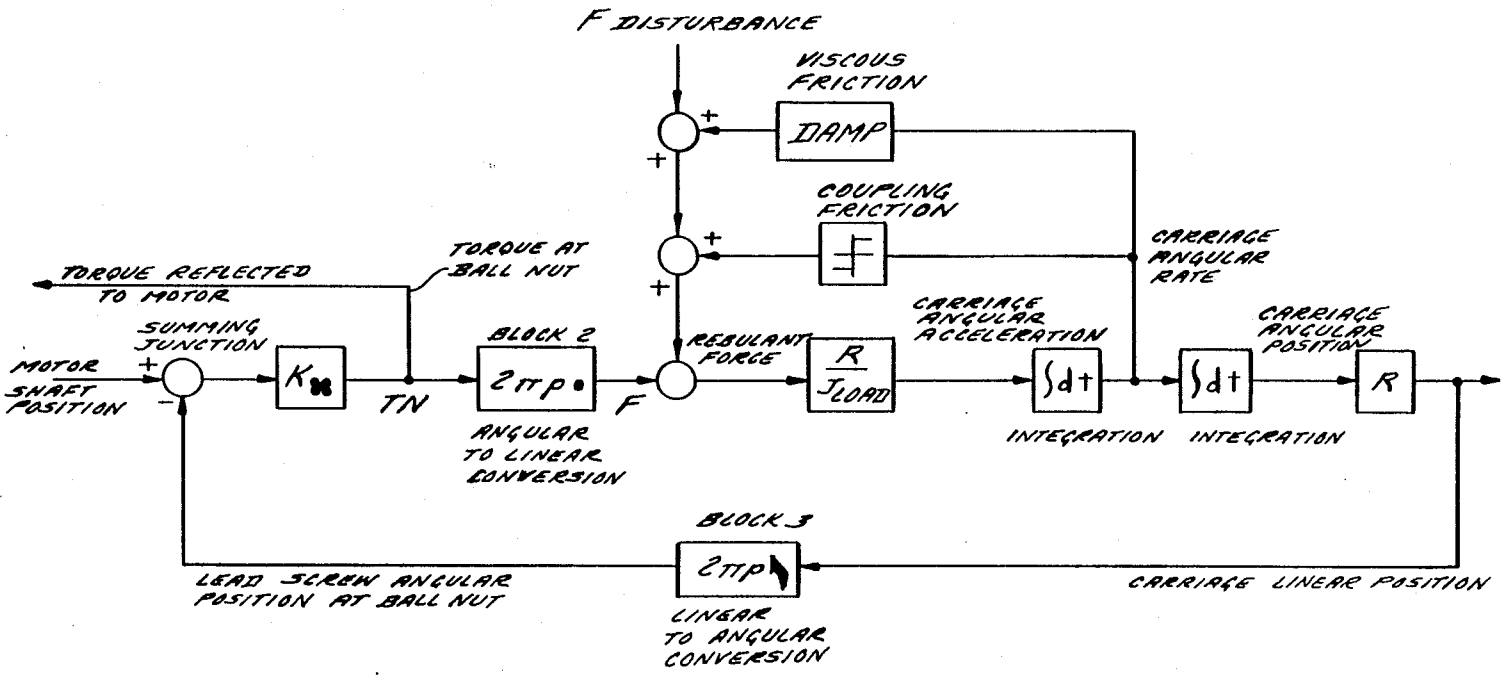
FIG. 7 is a load diagram for the lead screw and ball nut assembly employed in the assembly illustrated in FIG. 6.

FIG. 7 illustrates a dynamic interaction between motor 80 and frame 66 load diagram of lead screw and ball nut assembly 84. For simplification, the spring constants of all the components, such as the windup in the lead screw and deflection in the oar lock brackets, are combined as a single term, Kss. Rotary to linear force translation is represented (simulated) by $2\pi pe$ (in block 2). P and e are constants related to lead screw pitch (revolutions per inch) and efficiency, respectively. Ball nut assembly 84 produces a force (F) to overcome friction (determined by the rate of carriage movement) and to accelerate carriage 65. Torque (T) produced by force (F) acting through moment arm (R) causes angular acceleration of carriage 65. The rate of angular movement of carriage 65 is the integral of carriage acceleration. Carriage position, corresponding to ball nut position (and thus lead screw angle), in turn, is the integral of its angular rate. Linear to angular conversion is represented as $2\pi p$ (block 3). The difference between the lead screw angle at the nut and the motor shaft, multiplied by the lumped spring term produces torque (TN). This torque action is applied to the ball nut and the reaction is felt at the motor 80.

Figure 8:
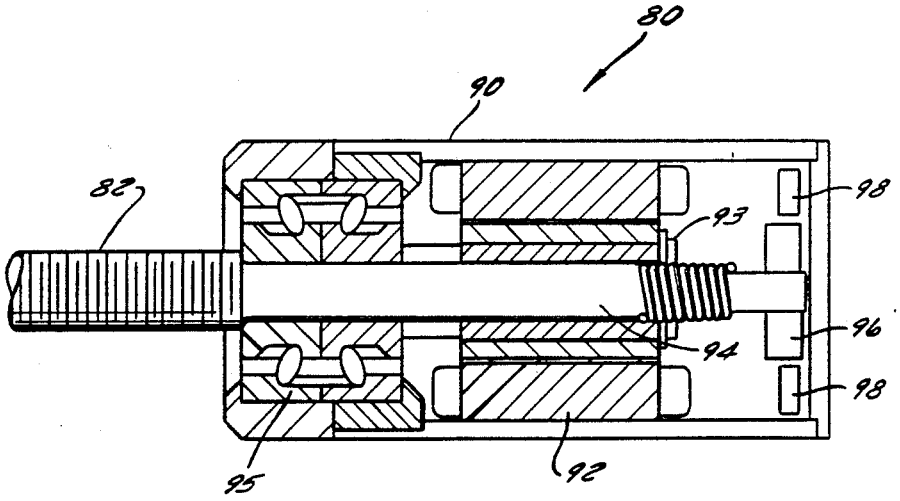
FIG. 8 is a sectional view of a DC brushless motor employed in the motor drive assembly illustrated in FIG. 6.

The use of a relatively low inertia brushless DC motor significantly reduces the possibility of resonances and oscillations caused by the dynamic interaction of motor assembly 72 and the carriage 65. As shown in FIG. 8, brushless DC motor 80 includes: a housing 90; a winding assembly 92; a rotor assembly 94, which includes integral lead screw 82; preloaded angular contact bearings 95; and a tachometer assembly consisting of a magnet ring 96 and Hall effect sensors 98. As illustrated in FIG. 8, angular contact bearings 95 are located in the front of the motor. However, other bearing configurations are possible. For example, a third bearing may be located at the rear of the motor, or a single bearing may be provided at the front and rear.

Rotor assembly 94 comprises lead screw 82 and respective permanent magnets. Inclusion of permanent magnets in the rotor is in contrast to a brush type DC motor where the magnets are attached to the housing and the windings are on the rotor. Rotor assembly 94, and thus motor 80, tends to weigh less and exhibit less inertia than the rotor of a standard DC motor.

Referring now to FIGS. 4 and 8, motor controller 75 electronically switches the phases of the motor windings 92 to cause rotation of rotor 94 (and thus lead screw 82). Motor controller 75 receives a pulse width modulated (PWM) signal from the control circuitry 76 and a tachometer feedback signal from the tachometer assembly (96, 98) which are used by the motor controller 75 to control the current to the motor 80. The motor 80 suitably has a continuous torque rating of 100 oz-in RMS and can also produce 200 oz-in torque pulses for limited periods of time.

Figure 9:
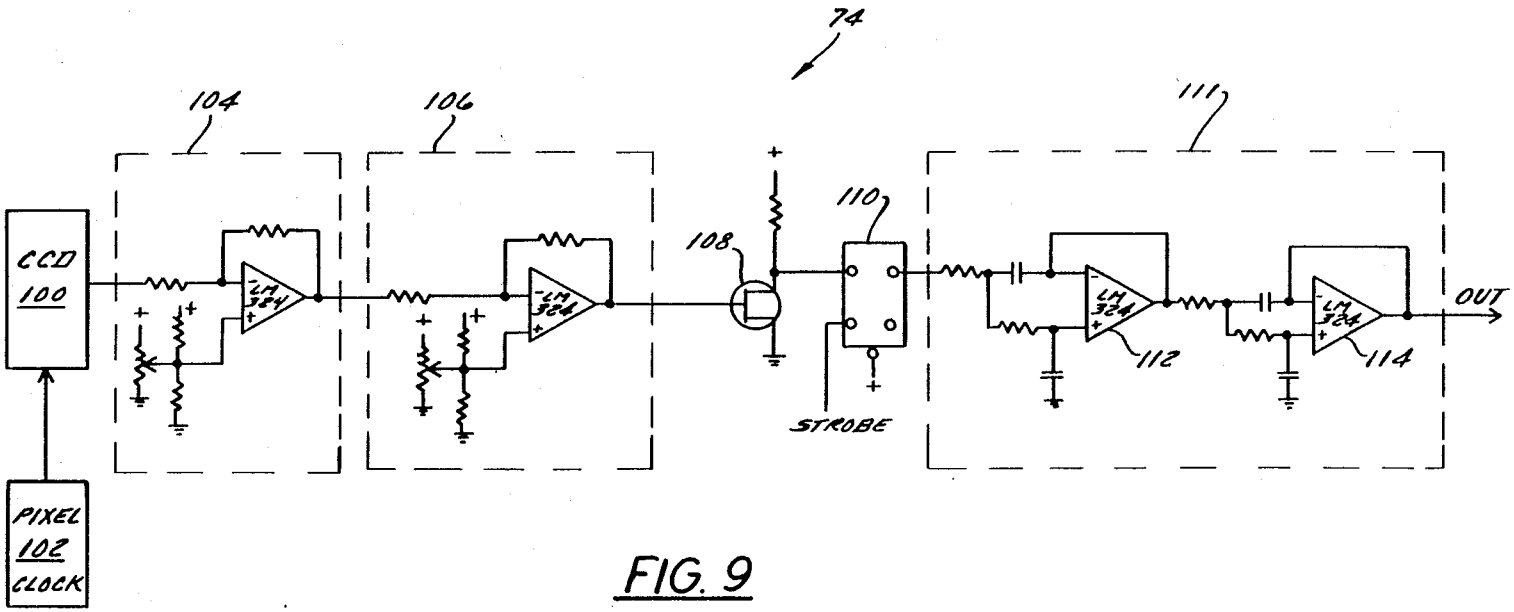
FIG. 9 is a schematic diagram of a sensor unit employed in the web guide illustrated in FIG. 4.

Motor 80 is actuated by motor controller 75 in accordance with signals indicative of the web position generated by sensing units 73 and 74 and control circuitry 76. Referring to FIG. 9, the sensing units 73 each suitably include: a CCD line sensor 100; a suitable clock 102; an amplifier 104; a level shifter and comparator 106; a switching transistor 108, a flip flop 110, and a suitable filter 111. CCD line sensor 100 (e.g., a Fairchild CCD 133) suitable has a resolution of, e.g., 1024 pixels/one-half inch. Infrared LEDs (not shown) are used to illuminate the pixels of the CCD line sensor 100. The use of LEDs for the illumination source reduces power requirements and susceptibility to background light. CCD line sensor 100 is positioned transverse to the edge of web 11.

Sensing units 73 generate an analog signal having a level indicative of the position of the edge of web 11 relative to CCD sensor 100. Web position is suitably sampled at a frequency of 2.5 Khz. Clock circuit 102 sequentially clocks out indicia of the charge stored in each pixel. The charge signals are applied, in sequence; through an amplifier 104, to level shifter and comparator circuit 106. Comparator 106 compares the charge signal to a predetermined threshold voltage level, and determines if the light reaching a particular pixel is blocked by the web (low voltage level) or unblocked (high voltage level). The output signal from comparator 106 is applied to a switching transistor 108, turning transistor 108 on in response to a high voltage level. Transistor 108, suitably a Signetics 2N7000 FETlington, preferably has a relatively high trip voltage of, e.g., 2.5 volts. As the transistor 108 is turned ON and OFF, signal pulses are provided to the input of flip-flop 110. The flip-flop 110 is used to render the signal pulses into TTL compatible logic levels. Filter 111, suitably comprising two LM324 operational amplifiers 112 and 114, effectively adds the number of pulses received and generates an analog output signal having an amplitude in accordance with the number pulses, suitably in the range of 0–5 volts. Thus, if the web is centered, one-half of the pixels will be blocked and a 2.5 volt output signal will be generated. The output signals from the sensing units 73 are then provided to the control circuitry 76.

Figure 10:
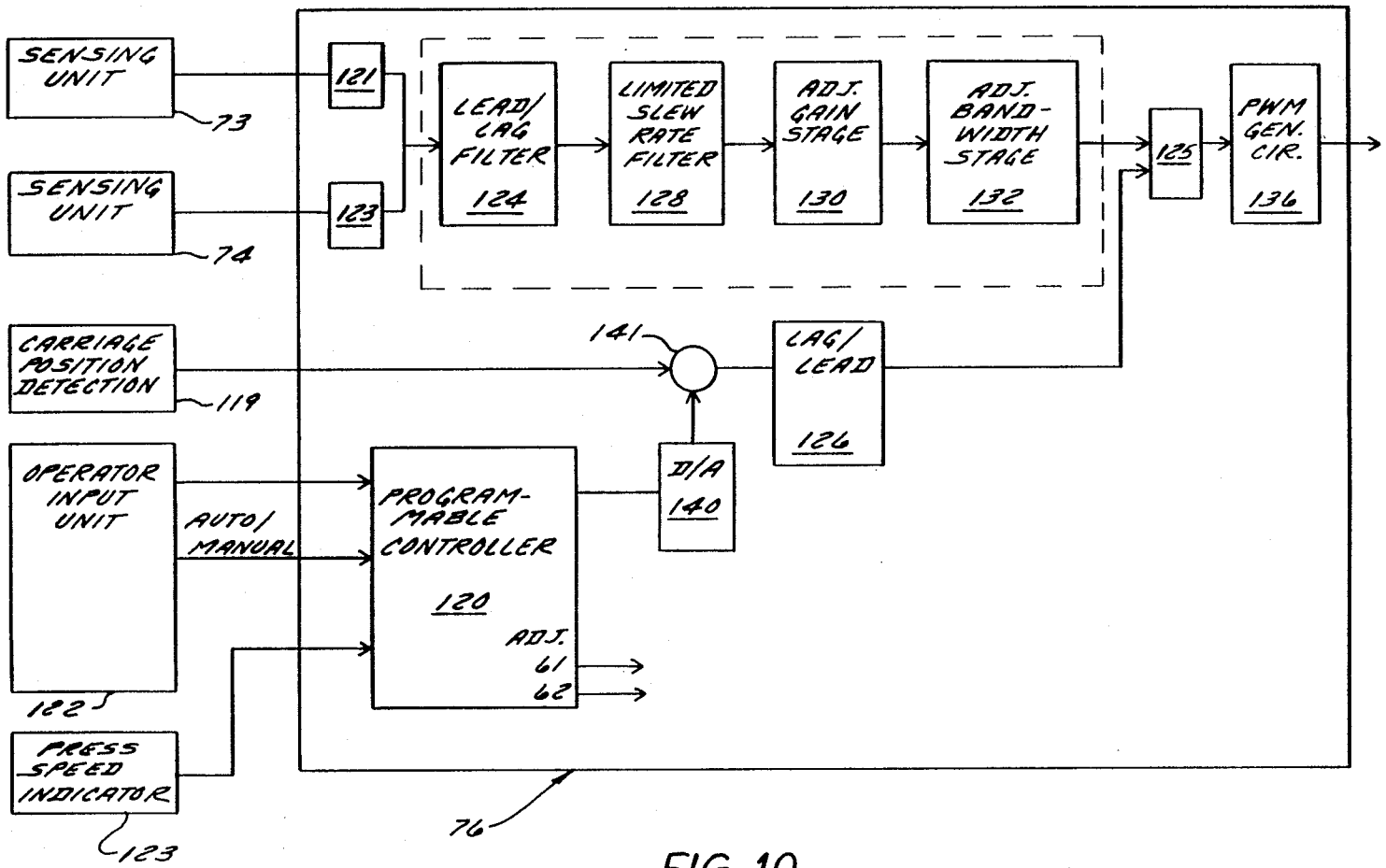
FIG. 10 is a block diagram of a control circuit employed in the web guide illustrated in FIG. 4

Referring now to FIG. 10, control circuitry 76 suitably includes: a programmable controller 120, (for example, an Intel 8085 microprocessor), that receives command signals from an operator input unit (such as a keyboard) 122; a proportional integral control circuit 110, including a lead/lag filter 124, a limited slew rate filter 128, an adjustable gain stage 130, and an adjustable bandwidth compensation stage 132; a Pulse Width Modulated (PWM) signal generator circuit 136; a digital to analog (D/A) converter 140; a summer 141, a lag/lead filter 126, and respective analog switches 21, 123 and 125.

Control circuitry 76 can be operated in alternative manual or automatic control modes. Programmable controller 120 activates switch 125 to select the automatic or manual mode based on an AUTO/MANUAL signal received from operator input unit 122.

In the manual control mode, carriage position is controlled in accordance with desired position entries provided to microprocessor 120 through keyboard 122. The manual mode is typically used by the operator during set up of the printing press to initially position the web. Indicia of the desired position from microprocessor controller 120 is converted into an analog signal by D/A converter 140 and is subtracted from a signal indicative of the actual position of carriage 66, generated by a suitable carriage position detector 119 (preferably a linear variable differential transformer). The resultant error signal is supplied to lag/lead filter 126. The filter 126 (and filter 124) provide error compensation for optimum performance, e.g., cancel zeros in the system response. If desired, filters 124 and 126 may be omitted from control circuitry 76, or other means of providing error compensation may be provided. The filtered error signal from lag/lead filter 126 is supplied to PWM signal generation circuit 136 via analog switch 125, which in turn generates corresponding PWM control signals for application to motor controller 75 to drive motor 80.

In the automatic mode, web position is maintained in accordance with the output signals received from one or more sensing units 73 selected by the operator. The output signals from sensing units 73 are selectively coupled to proportioned integral control circuit 118 through analog switches 121 and 123 (controlled by the programmable controller 120). Either of sensing units 73 can be selected using the operator input unit 122, to provide indicia of the position of the web. Alternatively, both sensing units 73 can be selected so that the web center is maintained in a central position.

Figure 11:
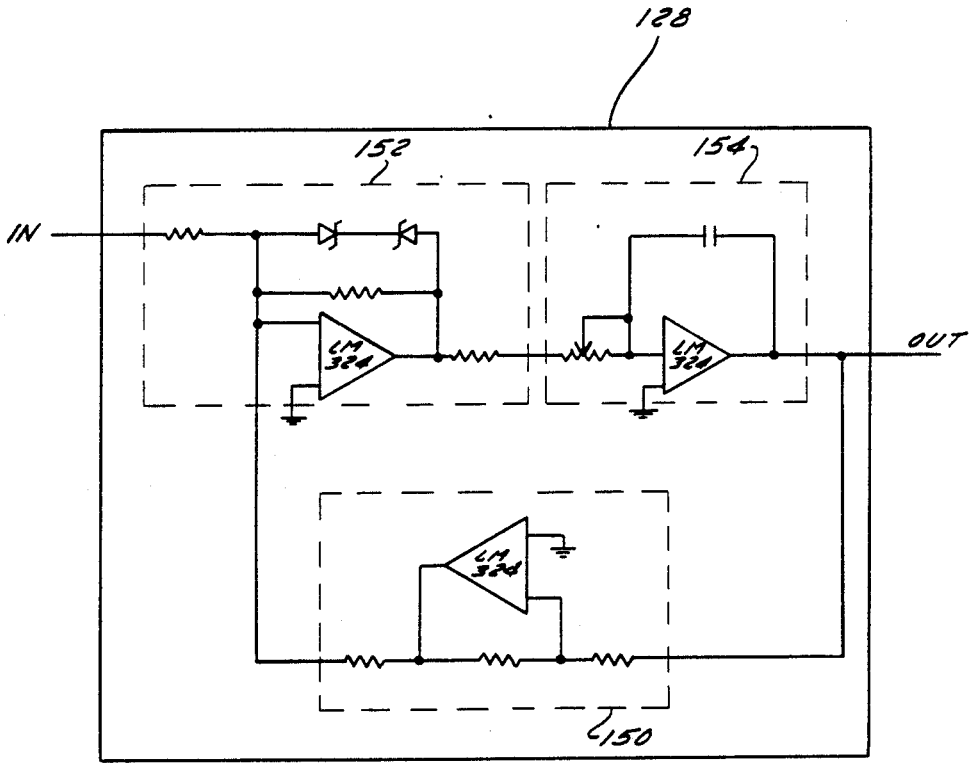
FIG. 11 is a schematic diagram of a limited slew rate filter employed in the control circuit of the web guide illustrated in FIG. 4.

Proportional integral controller 128 generates a control signal proportional to a linear combination of the signal indicative of the position of web 11 and the time integral thereof for application PWM signal generator 136. The selected sensor signal is applied through lead/-lag filter 124, to limited slew rate filter 128. Filter 128 acts as a nonlinear filter to block spurious high amplitude spikes not be caused by lateral movement of web. High amplitude spikes may be caused by, e.g. noise in the system or by breaks (tears) in web 11. Referring to in FIG. 11, slew rate filter 128 suitably comprises an inverter 150, a voltage limited high gain amplifier 152, and an integrator 154. Amplifier 152 provides an amplified output signal proportional to the error between the input and output of filter 128 so long as the output is below a predetermined level. The output signal is otherwise limited (clipped) to the predetermined level. Amplifier 152 is coupled to integrator 154. The output of amplifier 152 defines a current through the resistors of integrator 154. The output of integrator 154 is proportional to the integral of that current. When the output of amplifier 152 is below the predetermined level, filter 128 acts as a first order (single pole) low pass filter. However, when the output of amplifier 152 is limited (clipped), the current is to integrator 154 constant and the output voltage therefor ramps at a predetermined rate, generating a constant current through the integrator capacitor and limiting slew rate.

Limited slew rate filter 128 is coupled to adjustable gain stage 130. Gain stage 130 is used to compensate for web slippage on top idler. When the press runs at high speeds, a small amount of air begins to flow between the idler roller and the web. This aerodynamic effect causes the paper to float over the idler rollers. A greater displacement of the carriage is needed when "web float" occurs to effectively move the web, as the web is not in direct contact with the idler roller.

Adjustable bandwidth stage 132 is used to adjusts the bandwidth of the control loop during low tension operation. Low tension operation typically occurs when the printing press runs at less than 10 percent of its normal operating speed. The low tension can cause the web to flutter. This can be aggravated if the web guide tries to quickly respond to the flutter.

Figure 12:
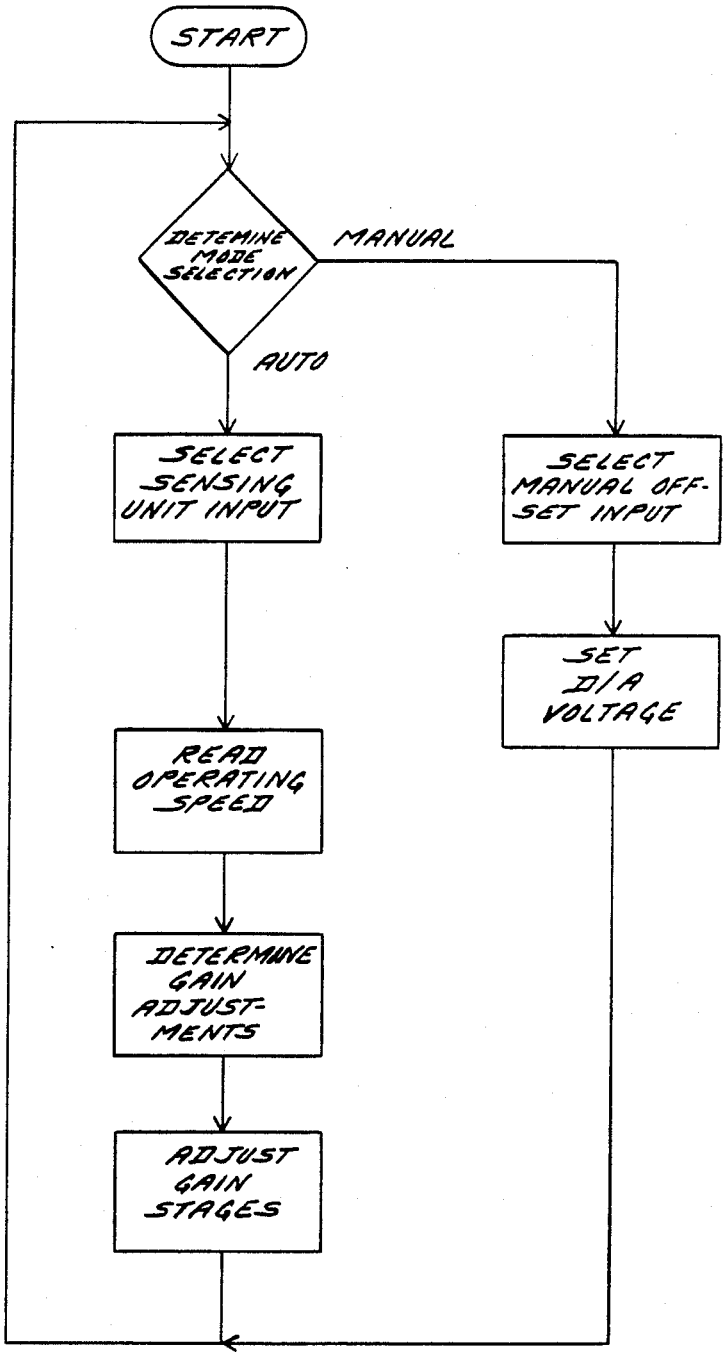
FIG. 12 is an operational flow diagram for a microprocessor controller employed in the control circuit illustrated in FIG. 10.

Microprocessor controller 122 monitors a press speed signal supplied by a press speed indicator and selects the gain of the stages accordingly. If desired, a tension sensor can be employed to determine the gain of the second stage rather than a percentage of operating speed. In a preferred embodiment, the gain of the first high gain stage 150 is reduced to ⅓ when the press speed is under 150 feet/ second. The gain is then gradually increased to full gain as the press speed increases from 150–1000 feet/ second. The particular gain adjustments vary, however, depending on the type of web being transported. A gain table can therefore be stored in the memory of the programmable controller so that the proper gain can be selected based on the press speed and the web characteristics as input by the operator. An operational flow diagram for the microprocessor controller 120 is provided in FIG. 12.

The above-described web guide is capable of controlling the lateral displacement of the web to 0.010 inch, has a bandwidth of at least 8 Hz and a resonant frequency significantly outside the bandwidth, e.g., at least 3 to 4 times the bandwidth. Thus, web weave can be effectively corrected.

It will be understood that various electrical connections between the elements are omitted from the drawing, and that while various of the connections are shown in the drawing as single lines, they are not so shown in a limiting sense. Connections may be made or may comprise plural conductors as is understood in the art. Further, the above description is of preferred exemplary embodiments of the present invention, and the invention is not limited to the specific forms shown. Variations and modification can be effected within the spirit and scope of the invention as expressed in the appended claims.

What is claimed is:

1. A web guide apparatus of the type comprising: a frame support; a carriage, including at least one idler roller; means for movably mounting said carriage to said frame support; and means for controllably moving said carriage to vary the lateral position of said web relative to said roller, said web guide having a predetermined response bandwidth with respect to the frequency of variations in said lateral position, and a natural resonance frequency, said web guide improved wherein:

said response bandwidth is greater than 1 Hz; and said natural resonance frequency is outside of said bandwidth.

2. The apparatus of claim 1 wherein said bandwidth is equal to at least approximately 2 Hz.

3. The apparatus of claim 1 wherein said bandwidth is equal to at least approximately 3 Hz.

4. The apparatus of claim 1 wherein said bandwidth is equal to at least approximately 4 Hz.

5. The apparatus of claim 1 wherein said bandwidth is equal to at least approximately 5 Hz.

6. The apparatus of claim 1 wherein said bandwidth is equal to at least approximately 6 Hz.

7. The apparatus of claim 1 wherein said bandwidth is equal to at least approximately 7 Hz.

8. The apparatus of claim 1 wherein said bandwidth is equal to at least approximately 8 Hz.

9. The apparatus of claim 1 wherein said frame support comprises two side plates, and a rigid tie plate connected between said side plates.

10. The apparatus of claim 1 wherein said means for controllably moving said carriage comprises a brushless DC motor having an integral lead screw, said motor being mounted on said frame support, and said lead screw being coupled to said carriage.

11. The apparatus of claim 1 wherein said frame includes stiffening means for substantially eliminating ringing responses of said frame.

12. The apparatus of claim 1 wherein said carriage manifests an inertia of no more than approximately 8.9 ft-lb-sec$^2$.

13. The apparatus of claim 1 wherein said resonant frequency is at least three times said bandwidth.

14. The apparatus of claim 1 wherein said resonant frequency is at least four times said bandwidth.

15. An apparatus for guiding a traveling web, said apparatus comprising:

a. a rigid support structure;

b. a carriage assembly movably coupled to said rigid support structure, said carriage including a frame and at least one idler roller mounted to said frame;

c. a motor drive assembly mounted to said rigid support structure and coupled to said frame of said carriage, said motor drive assembly including a brushless DC motor having an integral lead screw;

d. a motor controller circuit connected to said brushless DC motor;

e. a web position sensing unit that senses lateral displacement of the travelling web and generates an output signal indicative of the lateral displacement;

f. a control circuit that receives the output signal generated by said web position sensing unit and generates a signal that is supplied to said motor controller circuit to drive said brushless DC motor.

16. An apparatus as claimed in claim 15, wherein said frame and idler rollers are constructed of aluminum to reduce the inertia of said carriage assembly.

17. The apparatus of claim 15, wherein said apparatus has a predetermined response bandwidth with respect to the frequency of changes in said lateral displacement is equal to at least approximately 1 Hz.

18. The apparatus of claim 17 wherein said bandwidth is equal to at least approximately 8 Hz.

19. The apparatus of claim 15 wherein said apparatus has a natural resonance frequency outside of said bandwidth.

20. The apparatus of claim 19 wherein said resonance frequency is at least three times said bandwidth.

21. The apparatus of claim 15 wherein said web is subject to oscillation in position occuring within a range of frequencies and said rigid support structure has a resonant frequency outside of said range of frequencies.

22. An apparatus for guiding a traveling web, said apparatus comprising:

a. a rigid support structure including two side plates, a rigid tie plate connecting said side plates, and a horizontal plate coupled to said side plates and said rigid tie plate;

b. a carriage assembly movably coupled to said rigid support structure, said carriage including a frame and at least one idler roller mounted to said frame;

c. a motor drive assembly mounted to said rigid support structure and coupled to said frame of said carriage, said motor drive assembly including a brushless DC motor and a cooperating lead screw;

d. a motor controller circuit connected to said brushless DC motor;

e. a web position sensor that senses lateral displacement of the traveling web and generates an output signal indicative of the lateral displacement;

f. a control circuit that receives the output signal generated by said web position sensing unit and generates a signal that is supplied to said motor controller circuit to drive said brushless DC motor.

23. An apparatus as claimed in claim 22, wherein said carriage assembly is movably coupled to said rigid support structure via grooved rollers mounted to said frame that ride on guide rails that are directly mounted to said rigid tie plate.

24. An apparatus for guiding a traveling web, said apparatus comprising:

a. a rigid support structure;

b. a carriage assembly movably coupled to said rigid support structure, said carriage including a frame and at least one idler roller mounted to said frame;

c. a motor drive assembly mounted to said rigid support structure and coupled to said frame of said carriage, said motor drive assembly including a brushless DC motor, a lead screw cooperating with said brushless DC motor, a first oar lock bracket for mounting said brushless DC motor to said rigid support structure, a ball nut assembly, and a second oar lock bracket, said ball nut assembly and second oar lock bracket being provided to transmit linear motion of said lead screw to said frame;

d. a motor controller circuit connected to said brushless DC motor;

e. a web position sensor unit that senses lateral displacement of the traveling web and generates an output signal indicative of the lateral displacement;

f. a control circuit that receives the output signal generated by said web position sensing unit and generates a signal that is supplied to said motor controller circuit to drive said brushless DC motor.

25. An apparatus for guiding a traveling web, said apparatus comprising:

a. a rigid support structure;

b. a carriage assembly movably coupled to said rigid support structure, said carriage including a frame and at least one idler roller mounted to said frame;

c. a motor drive assembly mounted to said rigid support structure and coupled to said frame of said carriage, said motor drive assembly including a brushless DC motor including a Hall effect tachometer assembly and a lead screw cooperating with said motor;

d. a motor controller circuit connected to said brushless DC motor and responsive to an output signal from said Hall effect tachometer assembly;

e. a web position sensor that senses lateral displacement of the traveling web and generates an output signal indicative of the lateral displacement;

f. a control circuit that receives the output signal generated by said web position sensing unit and generates a signal that is supplied to said motor controller circuit to drive said brushless motor.

26. An apparatus for guiding a traveling web, said apparatus comprising:

a. a rigid support structure;

b. a carriage assembly movably coupled to said rigid support structure, said carriage including a frame and at least one idler roller mounted to said frame;

c. a motor drive assembly mounted to said rigid support structure and coupled to said frame of said carriage, said motor drive assembly including a brushless DC motor, and a cooperating lead screw;

d. a motor controller circuit connected to said brushless DC motor;

e. a web position sensor that senses lateral displacement of the traveling web and generates a output signal indicative of the lateral displacement;

f. a control circuit that receives the output signal generated by said web position sensing unit and generates a signal that is supplied to said motor controller circuit to drive said brushless DC motor, said control circuit comprising a programmable controller, a limited slew rate filter, a plurality of adjustable gain stages coupled to said limited slew rate filer, and a Pulse Width Modulated (PWM) signal generation circuit coupled to said adjustable gain stages.

27. An apparatus as claimed in claim 26, further comprising a second web position sensing unit that generates an output signal which is transmitted to said control circuit and switching means coupled to said microprocessor controller for receiving and selectively providing the outputs signals generated by said web position sensing units to said limited slew rate filter.

28. An apparatus for guiding a traveling web, said apparatus comprising:

a. a rigid support structure, said support structure including means for substantially eliminating ringing responses of said support structure;

b. a carriage assembly movably coupled to said rigid support structure, said carriage including a frame and at least one idler roller mounted to said frame;

c. a motor drive assembly mounted to said rigid support structure and coupled to said frame of said carriage, said motor drive assembly including a brushless DC motor and a cooperating lead screw;

d. a motor controller circuit connected to said brushless motor;

e. a web position sensor that senses lateral displacement of the traveling web and generates an output signal indicative of the lateral displacement;

f. a control circuit that receives the output signal generated by said position sensing unit and generates a signal that is supplied to said motor controller circuit to drive said brushless DC motor.

29. An apparatus for guiding a traveling web, said apparatus comprising:

a. a rigid support structure;

b. a carriage assembly movably coupled to said rigid support structure, said carriage including a frame and at least one idler roller mounted to said frame, said carriage assembly manifesting an inertia of no more than approximately 8.9 ft-lb-sec$^2$2;

c. a motor drive assembly mounted to said rigid support structure and coupled to said frame of said carriage, said motor drive assembly including a brushless DC motor and a cooperating lead screw;

d. a motor controller circuit connected to said brushless motor;

e. a web position sensor that senses lateral displacement of the travelling web and generates an output signal indicative of the lateral displacement;

f. a control circuit that receives the output signal generated by said web position sensing unit and generates a signal that is supplied to said motor controller circuit to drive said brushless DC motor.

30. Apparatus for guiding a traveling web, said web tending to be subject to oscillation in lateral position, said apparatus being of the type comprising a frame support tending to resonate at certain frequencies; a carriage including at least one idler roller; means for moveably mounting said carriage to said frame support; and means for controllably moving said carriage to vary the lateral position of said web relative to said roller, improved wherein:

said frame support resonant frequencies are outside the range of frequencies corresponding to said web oscillations.

31. The apparatus of claim 30 wherein said means for controllably moving said carriage comprises a brushless DC motor having an integral lead screw, said motor being mounted on said frame support, and said lead screw being coupled to said carriage.

* * * * *